United States Patent [19]

Van de Leest et al.

[11] 4,273,625

[45] Jun. 16, 1981

[54] METHOD OF TREATING OBJECTS THE SURFACE OF WHICH CONSISTS OF TIN

[75] Inventors: Renaat E. Van de Leest; Gerrit Krijl; Ewoud A. Boonzajer Flaes, all of Eindhoven, Netherlands

[73] Assignee: U.S. Philips Corporation, New York, N.Y.

[21] Appl. No.: 178,045

[22] Filed: Aug. 14, 1980

[30] Foreign Application Priority Data

Aug. 28, 1979 [NL] Netherlands ..... 7906441

[51] Int. Cl.[3] ..... C25D 11/00

[52] U.S. Cl. ..... 204/56 R; 204/140

[58] Field of Search ..... 204/140, 56 R, 23

[56] References Cited

U.S. PATENT DOCUMENTS

| | | | |
|---|---|---|---|
| 2,606,866 | 8/1952 | Neish | 204/140 |
| 2,794,775 | 6/1957 | Buckingham | 204/56 R |
| 2,906,677 | 9/1959 | Smith | 204/56 R |
| 3,281,341 | 10/1966 | Kharouf | 204/56 R |

*Primary Examiner*—T. M. Tufariello

*Attorney, Agent, or Firm*—Norman N. Spain

[57] ABSTRACT

Treating objects of which at least the surface consists of tin in order to obtain a satisfactory corrosion resistance. To this end the objects are subjected in a tungstate solution of at least 0.02 M and having a pH of 4–11 alternately to a cathodic and an anodic polarity (so-called periodically reversed current). The frequency with which the current reverses must be between 0.2 and 2 Hz and the current density must be between 0.2 and 1 A/dm$^2$, the ratio of the anodic to the cathodic density being from 0.5–1.

3 Claims, No Drawings

METHOD OF TREATING OBJECTS THE SURFACE OF WHICH CONSISTS OF TIN

The invention relates to a method of treating objects the surface of which consists of tin, and to objects treated by such a method.

There is a great deal of interest in the electronic industry in tin-plated metal components in view of the good solderability of tin. Tin has, however, a poor resistance to atmospheric corrosion. Another disadvantage is the occurrence of local corrosion ("pitting corrosion") which results in the subjacent metal being attacked.

It is known, for example from an article by R. A. Neish and J. G. Donelson in Food Technology 14, 37–42 (1960), to passivate tin surfaces by treating them in a bichromate solution. This may be done by merely dipping in the solution or by also applying a cathodic or anodic potential. The article indicates, that the best results are obtained when an anodic potential is applied to articles when they are immersed in the bichromate solution.

From an excerpt from an article by L. Bizheva and Khr. Petrov in Khim. Ind. (Sofia) 45 (1973), 158–159, published in Chem. Abstracts 80, 21978S (1974) it is known to treat tin surfaces by applying a 50 Hz a.c. voltage in a bichromate solution.

It appeared, however, that pitting corrosion in anodically passivated tin surfaces still occurred, when the solderability of the tin surface appeared to be reduced.

It is an object of the invention to provide a treatment of tin surfaces which achieves a good corrosion resistance and whereby good solderability of the tin is retained.

According to the invention, the method of treating objects of which at least the surface consists of tin, in which method the objects are alternately subjected to a cathodic and an anodic potential in an electrolytic solution is characterized in that the objects are subjected in an aqueous, weakly acid to weakly alkaline solution ($4<pH<11$) of a soluble tungstate in a concentration of at least 0.02 M to an electrolytic treatment, a periodically reversed current being applied to frequency of which is at least 0.2 Hz but nor more than 2 Hz, the absolute value of the maximum current density being at least 0.2 $A/dm^2$ but nor more than 1 $A/dm^2$, the ratio of the anodic current density to the cathodic current density being at least 0.5 and not more than 1 and the ratio of the anodic to cathodic pulse durations being not more than 2 and at least 0.02.

During the investigations which resulted in the invention, it appeared that the above-mentioned limits of each of the quantities stated are critical: outside these limits the solderability and/or corrosion resistance were insufficient.

The method according to the invention can be used for tin-plated steel, the tin having been applied electrolytically or by dipping, or for tin-plated copper, brass or phosphor-bronze.

The layer deposited from the tungstate solution is 0.03–0.2 μm, usually 0.05 μm, thick. A layer thicker than 0.2 μm adheres insufficiently to the subjacent tin layer.

The alternately cathodic and anodic current preferably has a rectangular waveform.

By way of example there now follows the description of a typical embodiment of the invention.

From a conventional bright tin-plating solution, a 5 μm tin layer is deposited on steel plates. Thereafter, the tin-plated plates are subjected to a periodically reversed current in an electrolyte solution which has the following composition per liter:

10 g $Na_2WO_4.2H_2O$
10 g $Na_2B_4O_7.10H_2O$
10 g $Na_2SO_4$ (pH=9)

at a temperature of 20° C., using a stainless steel counter electrode having approximately the same surface area as that of the tin-plated plates being treated. The current density is 0.5 $A/dm^2$ (absolute value) and the current reversal is effected with a frequency of 0.5 Hz, that is to say 1 sec. anodic and 1 sec. cathodic, the applied voltage having a square-wave form with the same values for the anodic and the cathodic currents.

In this manner a coloured layer is obtained which is 0.03–0.2 μm thick, consisting of a mixture of tunstenate and tin oxide. The colour depends on the layer thickness. The solderability of the treated tin surface is as good as that of newly deposited tin layers.

The corrosion resistance is tested by means of a salt spray test (IEC 68-2-4 test D) by spraying a mist of an aqueous NaCl solution containing 5% by weight of NaCl at ambient temperature on the surface for 7 days, and also by means of the damp test IEC 68-2-11, test Ka. Neither uniform nor local corrosion occurs, this in contrast with untreated tin which exhibits very extensively pitting corrosion, or with tin which has been anodically passivated with a bichromate solution, in which the extent of pitting by local corrosion occurs to a higher degree than in the untreated tin.

Comparable results are obtained by immersing Sn-plated steel samples (5 μm of Sn) in one of the following electrolyte-solutions, containing per liter.

| | |
|---|---|
| (a) | 40 gms of $KHCO_3$ |
| | 20 gms of $Na_2WO_4 . 2H_2O$ (pH = 9.5) |
| (b) | 40 gms of $Na_3PO_4$ |
| | $H_3PO_4$ till pH = 9.5 |
| | 20 gms of $Na_2WO_4 . 2H_2O$ |

The plates are subjected, as hereinbefore, at 20° C. with a stainless steel counter electrode to a periodically reversed current with a frequency of 0.5 c/s and a current density of 0.5 $A/dm^2$.

What is claimed is:

1. A method of treating objects of which at least the surface consists of tin, the objects being alternately subjected to a cathodic and to an anodic potential in an electrolyte solution, characterized in that the objects are subjected to an electrolytic treatment in an aqueous solution of a tungstate in a concentration of at least 0.02 M, and having a pH from 4 to 11, a periodically reversed current being applied whose frequency is at least 0.2 Hz but not more than 2 Hz, the current density in an absolute value of the maximum current density being at least 0.2 $A/dm^2$ but not more than 1 $A/dm^2$, the ratio of the anodic current density to the cathodic current density being at least 0.5 and not more than 1 and the ratio of the anodic to the cathodic pulse durations being not more than 2 and not less than 0.02 during a time sufficient to produce a layer having a thickness between 0.03 and 0.2 μm.

2. A method as claimed in claim 1, characterized in that the alternately cathodic and anodic current has a rectangular waveform.

3. Objects treated in accordance with the method as claimed in claim 1 or 2.

* * * * *